United States Patent [19]

Dutt

[11] Patent Number: 5,076,475

[45] Date of Patent: Dec. 31, 1991

[54] CONTAINER CLOSURE WITH POP-UP SPOUT FITMENT

[75] Inventor: Herbert V. Dutt, Sarasota, Fla.

[73] Assignee: Continental Plastics, Inc., Triadelphia, W. Va.

[21] Appl. No.: 463,296

[22] Filed: Jan. 10, 1990

[51] Int. Cl.[5] ..... B67D 3/00

[52] U.S. Cl. ..... 222/530; 222/538; 222/570

[58] Field of Search ..... 222/530, 538, 545, 546, 222/528, 573, 570, 527; 220/855 P

[56] References Cited

U.S. PATENT DOCUMENTS

| | | | |
|---|---|---|---|
| 2,898,018 | 8/1959 | Borah | 222/530 |
| 2,979,239 | 4/1961 | Collins | 222/530 |
| 2,993,628 | 7/1961 | Borah | 222/530 |
| 3,093,273 | 6/1963 | Borah | 222/530 |
| 3,405,850 | 10/1968 | Esposito, Jr. | 222/498 |
| 4,295,583 | 10/1981 | Schurr | 222/530 |
| 4,422,563 | 12/1983 | Babiol | 222/153 |
| 4,442,949 | 4/1984 | Dwinell et al. | 220/557 |
| 4,475,274 | 10/1984 | Beckstrom et al. | 222/545 |
| 4,569,464 | 2/1986 | Wassilieff | 222/546 |

FOREIGN PATENT DOCUMENTS

| | | | |
|---|---|---|---|
| 760495 | 10/1956 | United Kingdom | 222/530 |

*Primary Examiner*—Kevin P. Shaver
*Assistant Examiner*—Philippe Derakshani
*Attorney, Agent, or Firm*—Richard V. Westerhoff

[57] ABSTRACT

A resealable container enclosure includes a fitment with an annular body which snap fits over the mouth of a container, a resilient frusto-conical wall integrally molded with the annular body in a convex configuration to extend outward from the container, and a spout extending outward from frusto-conical wall. The enclosure includes a cap which, as it is screwed onto the container, engages the spout and deforms the resilient frusto-conical wall into the concave configuration producing bending moments which cause the spout to pop-up as the resilient frusto-conical spout returns to the convex configuration upon removal of the cap. A plurality of circumferentially spaced ribs extending axially and radially along the inner surface of the resilient frusto-conical stiffen the frusto-conical wall in the preferred embodiment of the invention.

20 Claims, 3 Drawing Sheets

CONTAINER CLOSURE WITH POP-UP SPOUT FITMENT

BACKGROUND OF THE INVENTION

1. Field of the Invention

This invention relates to closures for containers which include a sealable pour spout. In particular, the invention relates to such a closure in which a spout automatically pops up each time a replaceable cap is removed.

2. Background Information

In some container applications it is desirable to have a spout for dispensing the contents of the container, and in some instances to have a frusto-conical section which funnels the container contents to the spout. While in some containers the frusto-conical section is a permanent rigid part of the container itself or of a closure for the container, in others it is flexible and movable between a convex configuration for dispensing the container contents and a concave configuration in which the spout is stowed, at least partially, within the container. Examples of such "nestable" spout assemblies can be found in U.S. Pat. Nos. 2,898,018; 2,993,628; 3,093,273; 4,295,583; and 4,422,563. In these closures, the flexible frusto-conical section snaps over center in passing from the convex to the nested concave configuration and thus a force must be applied to move it from the nested position back through center to the convex configuration. In most cases, the nestable spout is pulled through center. However, in U.S. Pat. No. 3,093,273, the force required to snap the nestable spout assembly from the stored convex configuration to the deployed convex position is provided by the force of fluid in the container as the container is turned over.

U.S. Pat. No. 2,979,239 discloses a closure in which a convex flexible disc supporting a spout is deflected downward and placed in compression by a cap screwed onto the container. The disc remains convex throughout and the compression forces bias the spout against the cap to form a seal.

There has developed a need for a dispensing closure for a container such as for dispensing drinks which is provided with a frusto-conical section to direct the fluid to a spout which is nestable to save space during transport and storage, and which automatically deploys for use.

There is a related need for such a closure which will operate effectively despite prolonged storage.

There is a further need for such a closure which can be easily and economically manufactured.

SUMMARY OF THE INVENTION

These and other needs are satisfied by the invention which is directed to a two part closure including a fitment and a cap. The fitment has an annular body which engages a container opening. A resilient frusto-conical wall is molded integrally with the annular body in a convex configuration extending outward from the container beyond the annular body. The resilient frusto-conical wall is resiliently deformable into a concave configuration projecting inward from the annular body toward the container. A spout extends outward from a dispensing opening at the center of the frusto-conical wall. The cap has an annular skirt which engages the container, such as through cooperating threads to secure the cap over the fitment for storage. The end wall of the cap engages the spout and deforms the resilient frusto-conical wall into the concave configuration producing a bending moment in the resilient frusto-conical wall. When the cap is removed, the bending moment is relieved causing the resilient frusto-conical wall to pop back to the convex configuration for use. In the exemplary enclosure, the dimension of the frusto-conical wall extending radially and axially along the wall is less than the radius of the spout.

In the preferred form of the invention, the frusto-conical wall is provided with circumferentially spaced, axially and radially extending ribs, preferably on the inner surface, to stiffen the wall for supporting a greater bending moment while allowing the flexibility needed for the resilient frusto-conical wall to pass between the convex and concave configurations. Preferably, the stiffening ribs are thicker than the frusto-conical wall.

Reaction to the bending moment biases the spout against the end wall of the cap to form a first seal. In the preferred embodiment of the invention, an annular rib projecting from the inner surface of the end wall of the cap engages the annular body of the fitment to form a second seal.

As another aspect of the invention, a concentric annular flange on the end wall of the cap extends into the spout and projects beyond the dispensing opening in the frusto-conical wall to provide radial support for the spout as the conical wall passes between the convex and concave configuration.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
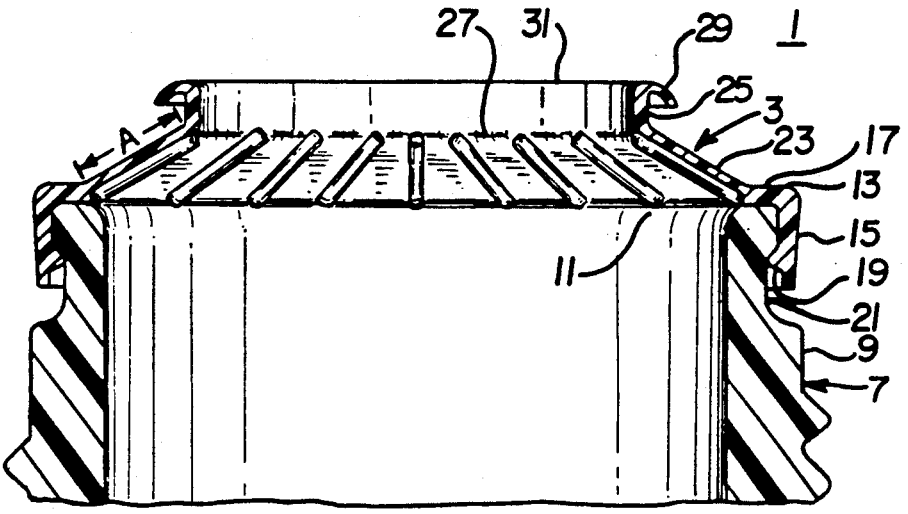
FIG. 1 is a vertical sectional view through a fitment in accordance with the invention in place on a container and shown in the convex configuration.

As shown in the FIGS. 1-5, the closure 1 of the invention comprises a fitment 3 and a cap 5 which are applied to a container 7 having a cylindrical neck 9 defining an opening 11. The fitment 3 has an annular body 13 which includes an annular side wall 15 and an annular flange 17 extending radially inward from the top end of the side wall 15. An annular bead 19 is provided on the inner surface near the lower end of the side wall 15. The bead 19 engages an annular recess 21 in the outer surface of the neck 9 of the container 7 to secure the fitment 3 over the opening 11 of container 7.

The fitment 3 includes a resilient frusto-conical wall 23 integrally molded to the flange 17 in a convex configuration as shown in FIG. 1, and an integral spout 25 extending axially from a central opening 27 in the frusto-conical wall 23 and terminating in a rolled lip 29 forming a dripless dispensing opening 31 for the container 7.

Figure 2:
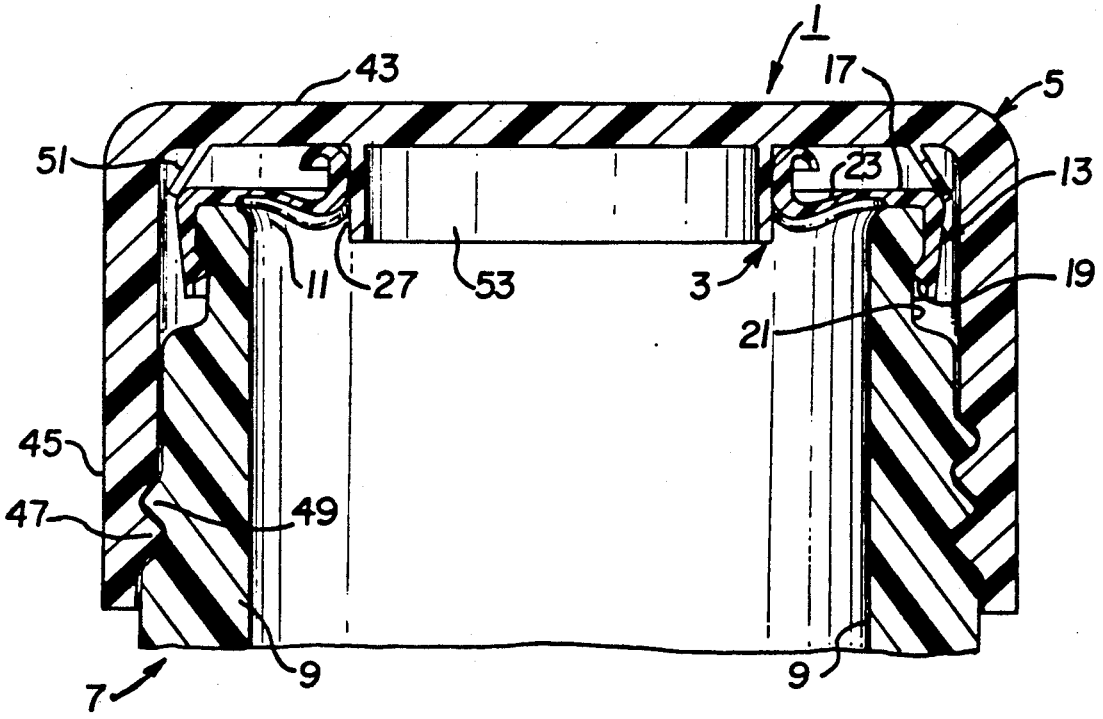
FIG. 2 is a vertical sectional view similar to that of FIG. 1 but with a cap which forms part of the invention in place and with the fitment in the stowed, concave configuration.
Figure 3:
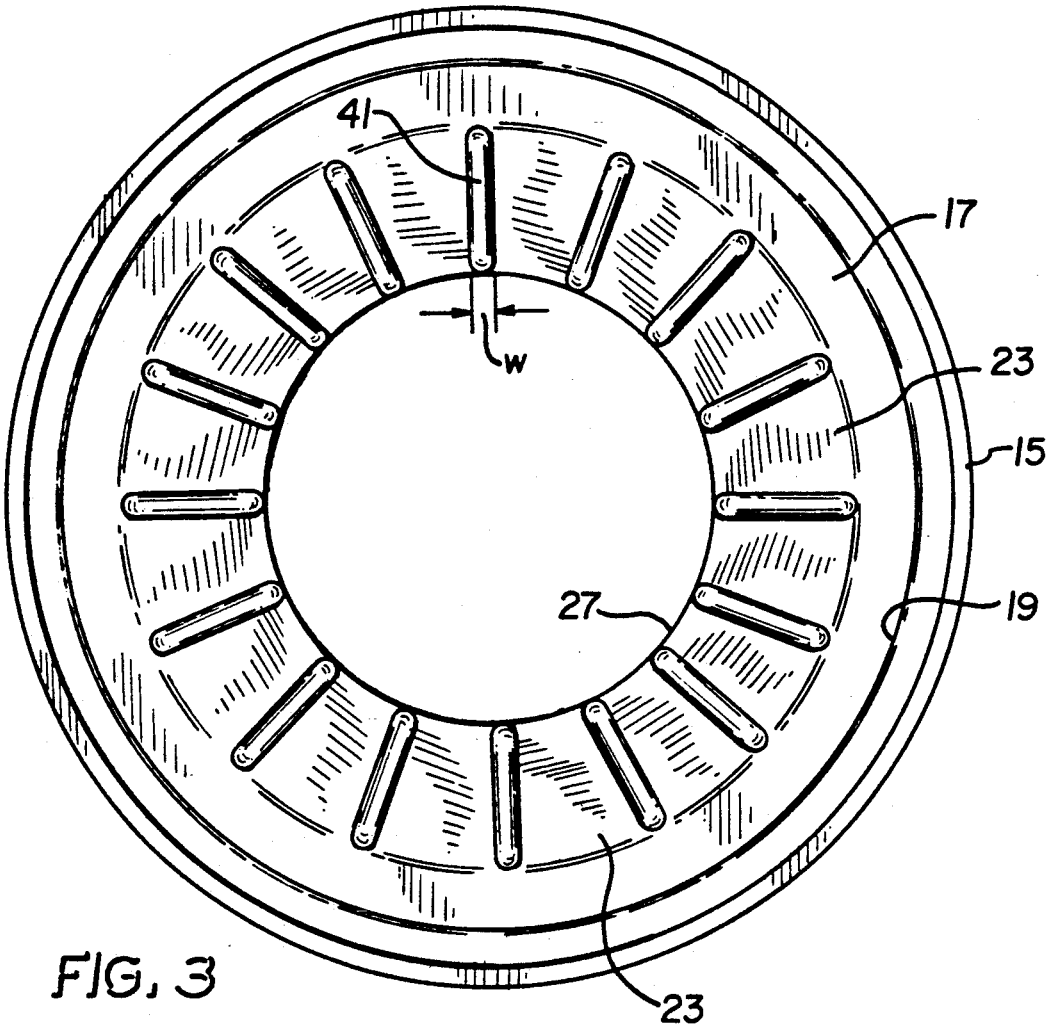
FIG. 3 is a bottom plan view of the fitment of FIGS. 1 and 2 shown in the convex configuration as in FIG. 1.
Figure 4:
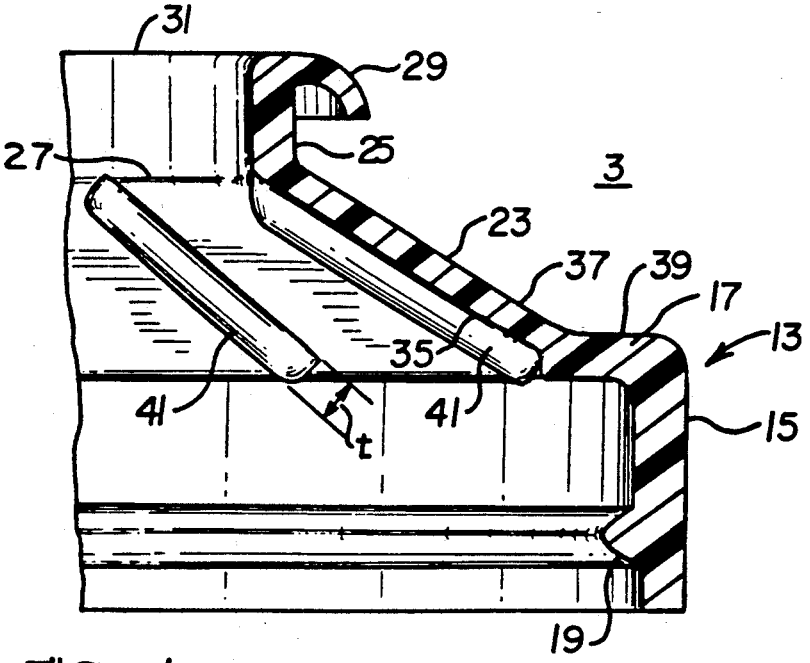
FIG. 4 is a fragmentary vertical section in enlarged scale though the fitment as shown in FIG. 1 in the convex configuration.
Figure 5:
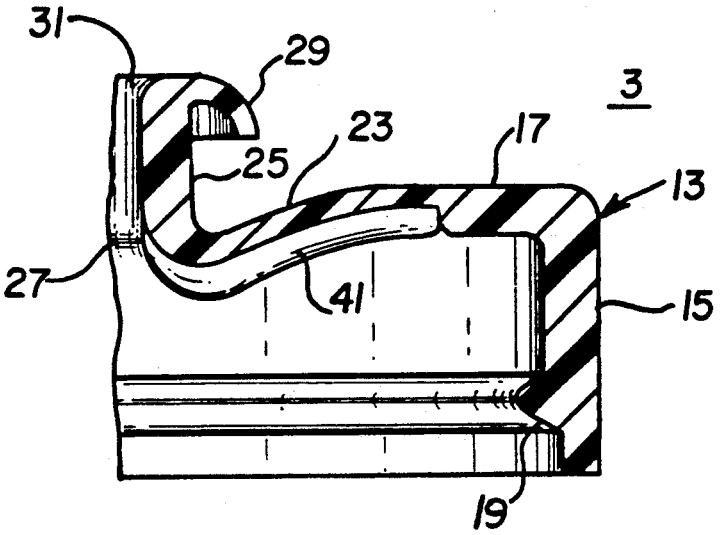
FIG. 5 is a vertical sectional view in enlarged scale through the fitment as shown in FIG. 2 in the concave configuration.

The frusto-conical wall 23 is thinner than the flange 17 on the body 13 of the fitment 3. In the exemplary embodiment of the fitment 3 shown, the inner wall 33 of the flange 17 facing the container tapers down to the inner wall 35 of the thinner frusto-conical wall section 23. The outer surface 37 of the frusto-conical wall 23 is substantially aligned with in a continuation of the outer surface 39 on the flange 17. A plurality of radially and axially extending ribs 41 are circumferentially distributed around the inner surface 35 of the frusto-conical wall 23. In the exemplary fitment, there are 16 such ribs 41 equaiangularly spaced around the frusto-conical wall 23. These ribs 41 have a thickness dimension, t, which is greater than their width, w, and preferably the thickness, t, is greater than the thickness of the frusto-conical wall 23. In the has a thickness of 0.020 inches and the thickness, t, of the ribs 41 is 0.030 inches. The ribs 41 provide stiffening to the frusto-conical wall 23 yet allow it to flex between the convex configuration as shown in FIGS. 1 and 4 in which the fitment is molded, and the concave position shown in FIGS. 2 and 5 illustrating stowed position of the fitment.

The closure 1 further includes the cap 5 having an end wall 43 and a cylindrical skirt 45, internal threads 47 on the skirt 45 engage external threads 49 on the neck 9 of the container 7 for securing the cap to the container. As the cap 5 is screwed on to the container 7, the end wall 45 contacts the rolled lip 29 on the spout 25 of the fitment 3 thereby pushing the spout downward into the container. This causes the frusto-conical wall 23 to flex from the concave position shown in FIG. 1 and 3 to the concave position shown in FIGS. 2 and 5. This flexure produces bending moments in the frusto-conical wall 23 and the integral ribs 41. Upon removal of the cap 5, these bending moments cause the spout 25 to pop up as the frusto-conical wall flexes back to the convex configuration of FIGS. 1 and 3 in which it was molded. As can seen in FIG. 1, the dimension or length A extending radially and axially along the frusto-conical wall 23 is less than the radius of the central opening 27 in the frusto-conical wall.

As the cap 5 is screwed on to the container thus forcing the frusto-conical wall 23 to flex from the convex to the concave configuration, a first seal is formed between the rolled lip 29 on the spout and the end wall 43 of the cap 5. An annular flange 51 extending axially and radially outward from the inner surface of the end wall 43 of the cap 5 seats against the annular body 13 of the fitment 3 to form a second seal as the cap 5 is fully screwed on to the container 7.

As can be seen from the drawings, the wall of the cylindrical section of the spout 25, which is integrally molded with the frusto-conical wall 23, is substantially thicker than the frusto-conical wall 23. This permits the spout to maintain its shape as the frusto-conical wall flexes from the convex to the concave configuration which produces compression forces within the frusto-conical wall which aid in its returning to the fully convex position shown in FIGS. 1 and 3. As another aspect of the invention, a cylindrical wall 53 extends from the end wall 43 on the cap through the spout 25. The cylindrical wall 53 helps to prevent collapse of the lower end of the spout 25 under the compression forces produced in the frusto-conical wall as it flexes between the convex and concave configurations.

Figure 6:
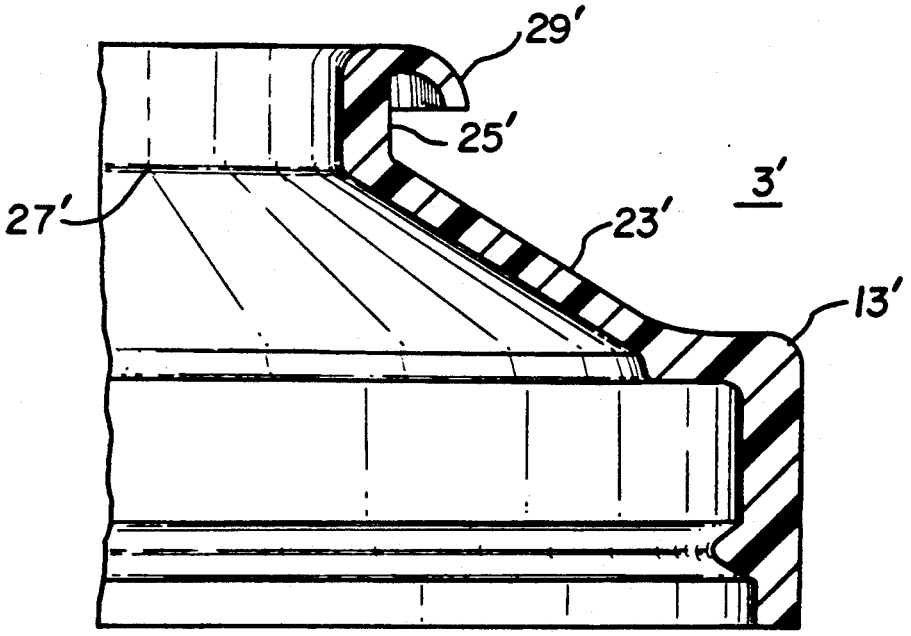
FIG. 6 is a vertical section through another embodiment of the invention shown in the convex configuration.

FIG. 6 illustrates another fitment 3' in accordance with the invention in which no stiffening ribs are provided on the frusto conical wall 23'. This embodiment of the fitment also automatically flexes from the concave stowed position to the convex position in which a fitment is molded upon removal of the cap from the container. However, the addition of the ribs 41 as shown in FIGS. 1 through 5, improves the performance of the fitment and provides for more rapid "pop up" of the spout upon removal of the cap.

Suitable materials for molding the fitments 3 and 3' are for example, polyethylene and polypropylene with a preferred material being low density polyethylene.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A closure for a container having a cylindrical opening, said closure comprising:
   - a fitment including:
     - an annular body which engages said cylindrical opening of said container;
     - a resilient frusto-conical wall molded integrally with said annular body in a configuration having a substantially convex outer surface and extending outward from said container beyond said annular body, and being resiliently deformable into a configuration having a substantially concave outer surface and projecting inward from said and projecting inward from said annular body towards the container, said resilient frusto-conical wall having a central opening;
   - a plurality of circumferentially spaced stiffening ribs extending radially and axially along said resilient frusto-conical wall; and
     - a spout extending outward from said central opening and forming a dispensing opening for said container; and
   - a cap having an end wall and a cylindrical skirt having means securing said cap to said container over said fitment, the end wall of said cap engaging said spout and deforming said resilient frusto-conical wall into said configuration having a substantially concave outer surface and extending inward toward said container, said resilient frusto-conical wall springing back to said configuration having a substantially convex outer surface when said cap is removed.

2. The closure of claim 1 wherein said stiffening ribs extend radially and axially along an inner surface of said frusto-conical wall facing said container.

3. The closure of claim 2 wherein said stiffening ribs are thicker than said frusto-conical wall.

4. The closure of claim 1 wherein the dimension of said frusto-conical wall extending radially and axially along said frusto-conical wall is less than the radius of said central opening in said frusto-conical wall.

5. The closure of claim 1 wherein said annular body of said fitment has a radially inwardly directed flange having an outer surface and inner surface facing said container, and wherein said resilient frusto-conical wall is integrally molded to said flange but is thinner than said flange with an outer surface substantially aligned with the outer surface of said flange at their intersection and an inner surface which tapers from the inner surface of said flange at their intersection and wherein said plurality of circumferentially spaced ribs extend axially and radially along the inner surface of said frusto-conical wall.

6. The closure of claim 5 wherein said ribs are thicker than said frusto-conical wall.

7. The closure of claim 6 wherein said ribs are about one and half times thicker than for said frusto-conical wall.

8. The closure of claim 6 wherein said ribs are thicker than they are wide.

9. The closure of claim 5 wherein said spout comprises a cylindrical section extending from the central opening in said resilient frusto-conical wall and a flared terminal portion which forms a dispensing opening for the container and which seats against the end wall of said cap to form a first seal.

10. The closure of claim 9 wherein said cylindrical section of said spout has a wall thickness greater than the thickness of said resilient frusto-conical wall.

11. The closure of claim 9 wherein said cap includes an annular sealing rib on said end wall which seats against the annular body of said fitment to form a second seal when said cap is secured on said container.

12. The closure of claim 1 wherein said spout includes a cylindrical section extending axially outward from the central opening in said resilient frusto-conical wall, and a dripless flared terminal portion which seats against the end wall of said cap to from a first seal.

13. The closure of claim 12 wherein said cap includes internal threads on said skirt which engage complimentary threads on said container, and an annular sealing rib on said end wall which seats against the annular body of said fitment to form a second seal when said cap is screwed onto said container.

14. The closure of claim 1 including a cylindrical wall projecting axially from the end wall of said cap which extends through said spout and central opening in said frusto-conical, wall to provide radial support for said spout at its intersection with said frusto-conical wall.

15. The closure at claim 14 wherein said spout includes a cylindrical section extending from the central opening in said resilient frusto-conical wall, said cylindrical section being thicker than said frusto-conical wall.

16. A closure for a container having a cylindrical opening, said closure comprising:

a fitment including:

an annular body which engages said cylindrical opening of said container;

a resilient frusto-conical wall molded integrally with said annular body in a configuration having a substantially convex outer surface and extending outward from said container beyond said annular body, and being resiliently deformable into a configuration having a substantially concave outer surface and projecting inward from said annular body toward said container, said frusto-conical wall having a length extending radially and axially along said frusto-conical wall said resilient frusto-conical wall having a central opening which has a radius greater than said length of said frusto-conical wall;

a plurality of circumferentially spaced ribs extending axially and radially along said resilient frusto-conical wall; and a spout extending outward from central opening in said frusto-conical wall; and a cap having an end wall and a cylindrical skirt having means securing said cap to said container over said fitment, the end wall of said cap engaging said spout and deforming said resilient frusto-conical wall into said configuration having a substantially concave outer surface and extending inward towards said container, said resilient frusto-conical wall springing back to said configuration having a substantially convex outer surface when said cap is removed.

17. The closure of claim 16 wherein said annular body of said fitment has a radially inwardly directed flange and wherein said spout includes a cylindrical section, said frusto-conical wall being thinner than said radially inwardly directed flange and said cylindrical section of said spout and wherein said resilient frusto-conical wall has an inner surface along which said plurality of ribs extend radially and axially.

18. The closure of claim 17 wherein said cap includes an annular wall extending axially from said end wall through said spout and said central opening in said resilient frusto-conical wall to provide radial support for said spout as said resilient frusto-conical wall flexes between said convex and concave configurations.

19. The closure of claim 18 wherein said cylindrical section of said spout terminates in a dripless flared terminal portion which seats against the end wall of said cap to form a first seal.

20. The closure of claim 19 wherein said cap includes internal threads on said skirt which engage complimentary threads on said container, and an annular sealing rib on said end wall which seats against the annular body of said fitment to form a second seal when said cap is screwed onto to said container.

* * * * *

UNITED STATES PATENT AND TRADEMARK OFFICE

CERTIFICATE OF CORRECTION

PATENT NO. : 5,076,475

DATED : December 31, 1991

INVENTOR(S) : HERBERT V. DUTT

It is certified that error appears in the above-identified patent and that said Letters Patent is hereby corrected as shown below:

Column 3, line 23, --exemplary fitment, for example, the frusto-conical wall 23-- should be inserted after the first occurrence of "the".

Column 4, line 41, delete "and projecting inward from said".

Column 5, line 38, "from" should be --form--.

Column 5, line 48, "," should be deleted.

Column 5, line 50, "at" should be --of--.

Signed and Sealed this

Ninth Day of August, 1994

Bruce Lehman

*Attest:*

BRUCE LEHMAN

*Attesting Officer*

*Commissioner of Patents and Trademarks*